US005867200A

United States Patent [19]

Tajima et al.

[11] Patent Number: 5,867,200

[45] Date of Patent: Feb. 2, 1999

[54] PRINT HEAD, AND PRINT PRE-HEAT METHOD AND APPARATUS USING THE SAME

[75] Inventors: Hiroki Tajima, Machida; Yutaka Koizumi, Yokohama; Toshio Kashino, Chigasaki; Seiichiro Karita; Haruhiko Terai, both of Yokohama; Kouichi Omata, Kawasaki; Masaru Iketani, Zama, all of Japan

[73] Assignee: Canon Kabushiki Kaisha, Tokyo, Japan

[21] Appl. No.: 548,515

[22] Filed: Oct. 26, 1995

[30] Foreign Application Priority Data

Oct. 27, 1994 [JP] Japan ..... 6-263990

[51] Int. Cl.[6] ..... B41J 2/355; B41J 29/38

[52] U.S. Cl. ..... 347/211; 347/13; 347/60; 347/186

[58] Field of Search ..... 347/13, 60, 186, 347/211

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,835,549 | 5/1989 | Samejima et al. | 346/76 PH |
| 5,006,867 | 4/1991 | Koizumi et al. | 346/140 R |
| 5,157,411 | 10/1992 | Takekoshi et al. | 347/13 |
| 5,164,747 | 11/1992 | Osada et al. | 346/140 R |
| 5,172,134 | 12/1992 | Kishida et al. | 347/13 |
| 5,235,351 | 8/1993 | Koizumi | 346/140 R |
| 5,305,024 | 4/1994 | Moriguchi et al. | 346/140 R |
| 5,353,051 | 10/1994 | Katayama et al. | 347/13 |
| 5,451,988 | 9/1995 | Ono | 347/185 |
| 5,559,535 | 9/1996 | Otsuka et al. | 347/14 |
| 5,646,672 | 7/1997 | Fukushima | 347/211 |

FOREIGN PATENT DOCUMENTS

| | | |
|---|---|---|
| 0390202 | 10/1990 | European Pat. Off. . |
| 0440490 | 8/1991 | European Pat. Off. . |
| 0440492 | 8/1991 | European Pat. Off. . |
| 0445916 | 9/1991 | European Pat. Off. . |
| 0475638 | 3/1992 | European Pat. Off. . |
| 0511602 | 11/1992 | European Pat. Off. . |
| 0605207 | 7/1994 | European Pat. Off. . |
| 0609997 | 8/1994 | European Pat. Off. . |
| 0670219 | 9/1995 | European Pat. Off. . |
| 2843064 | 4/1979 | Germany . |
| 54-51837 | 4/1979 | Japan . |
| 54-56847 | 5/1979 | Japan . |
| 59-123670 | 7/1984 | Japan . |
| 59-138461 | 8/1984 | Japan . |
| 60-71260 | 4/1985 | Japan . |
| 3-227664 | 10/1991 | Japan . |

*Primary Examiner*—Stuart N. Hecker
*Attorney, Agent, or Firm*—Fitzpatrick, Cella, Harper & Scinto

[57] ABSTRACT

A print head of this invention has a plurality of heater boards, and each heater board has a plurality of heating resistors, driver circuits corresponding to the heating resistors, one shiftregister for inputting serial data, a data latch circuit for latching print data input from the shift register, a pre-heat data latch circuit for latching selection data of selecting one or several of pre-heat signals input from the shift register, and a pre-heat selection circuit for selecting one or a plurality of pre-heat signals in accordance with the selection data latched in the pre-heat data latch circuit. In a print operation, one or several of the plurality of input pre-heat signals are selected to pre-heat the heating resistors, and when a main heat signal is input thereafter, the heating resistors are driven in accordance with the print data latched by the data latch circuit, thus performing the print operation.

23 Claims, 13 Drawing Sheets

PRINT HEAD, AND PRINT PRE-HEAT METHOD AND APPARATUS USING THE SAME

BACKGROUND OF THE INVENTION

The present invention relates to a print head comprising heating resistors as electro-thermal conversion elements, and a print apparatus using the same.

Ink-jet print methods have received a lot of attention owing to their advantageous features, i.e., since they can reduce noise upon printing to a negligible level, allows high-speed printing, can print an image on a so-called normal paper sheet by fixing an ink without requiring any special processing, and so on.

Of these methods, an ink-jet method described in Japanese Patent Publication No. 54-51837 and DOLS (German Laid-Open) No. 2843064 has a feature different from other ink-jet print methods in that heat energy is applied to a liquid to obtain a driving force for ejecting liquid droplets. More specifically, in the print method disclosed in the above-mentioned references, a liquid undergoes a change in state accompanied by an abrupt increase in volume upon application of heat energy, and a liquid is ejected from orifices at the distal end of an ink-jet head by the force based on the change in state, thus forming flying liquid droplets. The liquid droplets become attached to a recording medium to attain printing.

In particular, the ink-jet print method disclosed in DOLS No. 2843064 above can be very effectively applied to a so-called drop-on-demand print method. Furthermore, since a full-line type ink-jet print head having a high-density multi-orifice structure can be easily realized, an image with a high resolution and high image quality can be obtained at high speed.

An ink-jet print head of an apparatus applied to this print method includes a print head board which comprises orifices arranged for ejecting a liquid, liquid ejection portions having liquid channels each including a heat applying portion as a portion for applying heat energy to a liquid for ejecting a liquid droplet, and electro-thermal conversion elements (heating resistors) as means for generating heat energy.

In recent years, as the above-mentioned print head board, one, in which an array of a plurality of heating resistors, drivers which have a one-to-one correspondence with these heating resistors and drive the heating resistors in correspondence with image data, a shift register which has the same number of bits as the heating resistors and parallelly outputs serially input image data to the drivers, and a latch circuit for temporarily storing data output from the shift register are arranged on a single circuit board, has been developed.

FIG. 12 shows the circuit arrangement of such a conventional print head board 300. Referring to FIG. 12, reference numeral 301 denotes an array of heating resistors; 302, power transistors serving as drivers; 303, a latch circuit; and 304, a shift register. Reference numeral 305 denotes a clock signal which is used for shift-inputting data in the shift register 304. Reference numeral 306 denotes serial image data input to the shift register 304. Reference numeral 307 denotes a latch signal; and 308, a heat pulse signal for externally controlling the ON times of the power transistors 302. Reference numeral 309 denotes a logic power supply; and 310, ground. Reference numeral 311 denotes a power supply (VH) input for driving the heating resistors 301.

In a printer apparatus having the head including the print head board with the above-mentioned arrangement, the serial data 306 is serially input to the shift register 304. The image data set in the shift register 304 is latched by the latch circuit 303 in response to the latch signal 307. When the heat pulse signal 308 is input, power transistors 302 corresponding to data "1" of the image data are set in the ON state. In this manner, the corresponding heating resistors 301 are energized and driven, ink in the liquid channels of the driven heating resistors 301 is heated, and the ink drops are ejected from the orifices, thus achieving printing.

Upon consideration of energy required for forming bubbles in a liquid portion contacting the heating resistor 301, if a heat dissipation condition remains the same, the energy corresponds to the product of required input energy per unit area of the heating resistor 301 and the area of the heating resistor 301. For this reason, the voltage applied across both ends of the heating resistor 301, and the current and time (pulse width) flowing through the heating resistor 301 can be set to obtain the above-mentioned energy. In practical use, the voltage can be set to be almost constant by the power supply of the printer apparatus main body. However, as for the current, the resistances of the heating resistors 301 have different values depending on lots and boards due to a variation in film thickness of the heating resistor 301 in the manufacture of the board. Therefore, when the application pulse width is constant, and the resistance of the heating resistor 301 becomes higher than a setting value, the current value decreases, and the application energy becomes insufficient. As a result, the ink cannot form bubbles. On the contrary, when the resistance of the heating resistor 301 becomes small, and the current value flowing through the heating resistor becomes larger than the setting value, excessive energy is input, resulting in burning and short service life of the heating resistor 301. In order to prevent this problem, a sensor 314 always monitors the resistance value of the heating resistor 301, and the power supply voltage or the application pulse width is changed based on the detected resistance value, so as to apply constant energy.

Next, upon consideration of the ejection amount of a liquid droplet to be ejected, the ejection amount is associated with the bubble formation volume of an ink. Since the bubble formation volume of the ink changes depending on the temperature of the heating resistor 301 and the ambient temperature, a pulse (pre-heat pulse) having energy low enough not to eject an ink is applied before an applying of a heat pulse for ejection, so as to adjust the temperature of the heating resistors 301 by the pulse width and timing of the pre-heat pulse. In this manner, a liquid droplet of a predetermined amount is ejected, and a desired print quality is maintained.

According to the above-mentioned prior art, correction of a variation in resistance value of each heating resistor 301 and temperature control of the board can be realized by changing the width of the heat pulse, and the width and timing of the pre-heat pulse to be applied to the heating resistors 301 is changed under the control of the printer apparatus main body by feeding back signals from the sensor 314 for monitoring the resistance value and a temperature sensor 315 for monitoring the temperature, and for outputting the heat signal. However, the ink ejection amounts vary depending on nozzles due to a variation in area of orifice apertures, a variation in thickness of the protection films of the heating resistors 301, and the like in the manufacture in addition to the above-mentioned factors even when the same energy is applied to the heating registers 301. Such variations results in density nonuniformity, stripes, and the like on printed matter, and hence ejection amount control for each nozzle or several nozzles is required.

When a plurality of print head boards are connected in series with each other to form a multi-nozzle ink-jet head to meet demand for an increase in the number of nozzles of an ink-jet head, since each of the print head boards has the heating resistors 301 having different resistance value from those of other print head board, the heat pulse width for ejecting an ink must be changed in each board to generate almost the same energy in the respective boards. As described above, when the print head is constituted by a plurality of boards, the print density difference between adjacent boards becomes conspicuous in addition to the above-mentioned orifice area. For this reason, it becomes more important to correct the ejection amount of ink in units of nozzles (heating resistors) in the board than in the case of a print head constituted by a single board.

SUMMARY OF THE INVENTION

The present invention has been made in consideration of the above situation, and has as its object to provide a print head which can perform a print operation while correcting a variation of the respective print elements without largely increasing the size of a head circuit board of the print head.

It is another object of the present invention to provide a print head, which can attain various energization driving operations while reducing the processing load on the print apparatus side.

It is still another object of the present invention to provide a print head, which can correct a change of a print characteristic using a heat pulse, which results from a variation in resistance value of heating resistors.

It is still another object of the present invention to provide a print method and apparatus, which can perform a print operation while correcting a variation of the print elements of a print head.

It is still another object of the present invention to provide a print method and apparatus, which can attain various energization driving operations while reducing the processing load on the print apparatus side.

It is still another object of the present invention to provide a print method and apparatus, which can perform a print operation while adjusting a print characteristic attributed to a variation in resistance value of heating resistors using a heat pulse.

It is still another object of the present invention to provide a print method and apparatus, which can perform a print operation while adjusting a variation in print characteristic of a print head using a heat pulse.

It is still another object of the present invention to provide a print method and apparatus, which can perform a print operation while easily adjusting a variation in heating resistors of all boards even in a print head constituted by a plurality of boards.

It is still another object of the present invention to provide a print head having energization members for driving a plurality of print elements and a circuit for energizing the energization members in correspondence with print data to perform a print operation, comprising input terminals for inputting a plurality of pulse signals used for pre-heating the print elements, a storage circuit for receiving and storing selection information for selecting one of the plurality of pulse signals input from said input terminals, and driving circuits, each of which selects one of the plurality of pulse signals input from said input terminals in accordance with the selection information stored in said storage circuit, and applies the selected pulse signal to at least two energization member units to pre-heat the print elements.

It is still another object of the present invention to provide print head constituted by using a plurality of boards each having energization members for driving a plurality of print elements and a circuit for energizing the energization members in correspondence with print data to perform a print operation, wherein each of the boards comprises input terminals for inputting a plurality of pre-heat pulse signals to the energization.members, a storage circuit for receiving and storing selection information for selecting one of the plurality of pulse signals input from said input terminals, and driving circuits, each of which selects one of the plurality of pre-heat pulse signals input from said input terminals in accordance with the selection information stored in said storage circuit and applies the selected pre-heat pulse signal to at least two energization member units to pre-heat the print elements.

It is still another object of the present invention to provide a print apparatus for printing an image on a recording medium by energizing and driving a print head, said print head having energization members for driving a plurality of print elements, input terminals for inputting a plurality of pre-heat pulse signals to said energization members, a storage circuit for receiving and storing selection information for selecting one of the plurality of pre-heat pulse signals input from said input terminals, and driving circuits, each of which selects one of the plurality of pre-heat pulse signals input from said input terminals in accordance with the selection information stored in said storage circuit and applies the selected pre-heat pulse signal to at least two energization members, said apparatus comprising characteristic information storage means for storing print characteristics of said print elements of said print head, transfer means for determining the selection information on the basis of the print characteristics stored in said characteristic storage information storage means, and transferring the determined selection information to said print head, preliminary energization means for pre-heating at least two print elements by outputting the plurality of pulse signals to said print head prior to a print operation, and print energization means for energizing said energization members of said print head so as to perform the print operation after the pre-heating operation by said preliminary energization means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

DESCRIPTION OF THE PREFERRED EMBODIMENTS

The preferred embodiments of the present invention will be described in detail hereinafter with reference to the accompanying drawings.

<First Embodiment>

Figure 1:
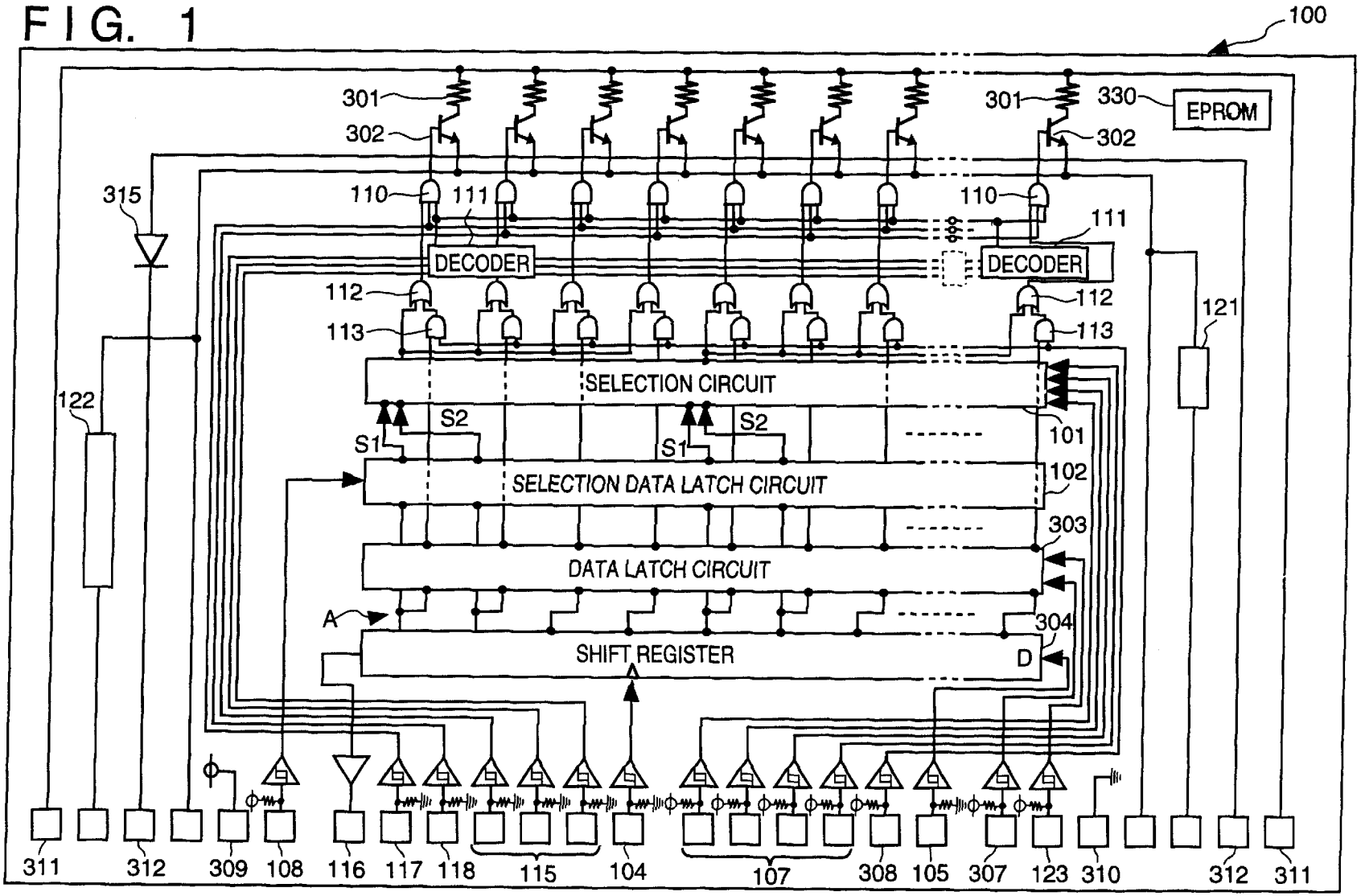
FIG. 1 is a block diagram of an ink-jet print head board used in an ink-jet printer apparatus according to the first embodiment of the present invention.
Figure 12:
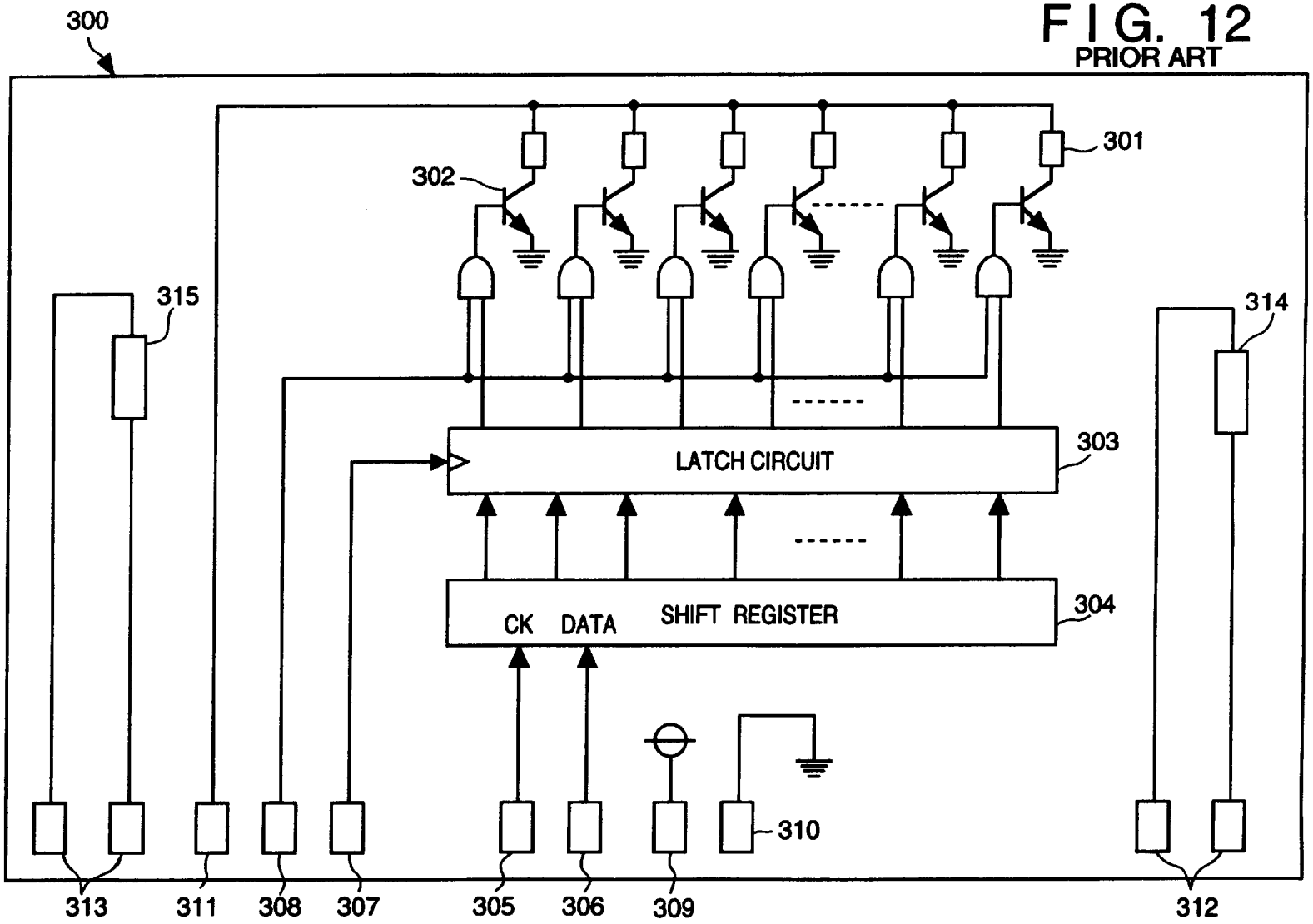
FIG. 12 PRIOR ART
FIG. 12 is a block diagram of a conventional ink-jet print head board.

FIG. 1 is a circuit diagram showing the circuit arrangement of an ink-jet head board (to be referred to as a heater board hereinafter) 100 of this embodiment. The same reference numerals in FIG. 1 denote the same parts as in the circuit diagram of FIG. 12 showing the conventional circuit.

As shown in FIG. 1, the heater board 100 has a plurality of input/output terminals, and various signals and electric power are supplied via these terminals. Reference numeral 101 denotes a pre-heat pulse selection circuit (to be simply referred to as a selection circuit hereinafter) for selecting a pre-heat pulse width (to be described later with reference to FIGS. 3A to 4B); 102, a selection data latch circuit for storing selection data (S1 and S2 in FIGS. 3A to 4B) for selecting a pre-heat pulse; and 303, a data latch circuit for latching print data. Reference numeral 304 denotes a shift register for serially receiving print data 105 and selection data for selecting one or several of pre-heat pulse signals 107 in synchronism with a shift clock 104, and for holding the received data. The pre-heat pulse signals 107 are input from a controller (e.g., an MPU 1701 in FIG. 8) of the ink-jet printer apparatus of this embodiment. Reference numeral 111 denotes 3–8 decoders, for example. In this embodiment, each decoder 111 outputs a decode signal in accordance with a 3-bit block selection signal 115, and a plurality of heating resistors 301 are divisionally energized and driven in eight blocks in accordance with the decode signal.

Reference numeral 112 denotes OR gates each for logically ORing a heat pulse output from a corresponding AND gate 113 in correspondence with print data, and a pre-heat pulse signal selected and output by the selection circuit 101, and outputting the OR to a corresponding AND gate 110. In this manner, when the output from each AND gate 110 changes to High level, a corresponding transistor 302 is turned on, and a current is supplied to the heating resistor 301 connected thereto, thus flowing an electric current through the resistor 301 to generate heat. Reference numerals 121 and 122 denote heaters. When a temperature sensor 315 detects that the temperature of the heater board 100 becomes equal to or lower than a predetermined temperature, these heaters 121 and 122 are energized to increase the temperature of the heater board 100. Reference numeral 315 denotes a temperature sensor.

Reference numeral 108 denotes a latch signal of the selection data, which signal latches the selection data of the pre-heat data, set in the shift register 304, into the selection data latch circuit 102. Reference numeral 116 denotes data which is shift-output from the shift register 304, and is to be shift-output to the next heater board (e.g., from a heater board 200-1 to a heater board 200-2 in FIG. 2). In this manner, serial data is sequentially transferred to the second and subsequent heater boards in synchronism with the shift clocks 104. Reference numerals 117 and 118 denote control signals used for separately driving odd- and even-numbered heating resistors to generate heat upon energization driving of the heating resistors 301. When the odd- and even-numbered heating resistors are separately driven, the influence of heat between adjacent resistors (nozzles) can be eliminated. Reference numeral 307 denotes a latch signal for latching print data in the data latch circuit 303; and 123, a clear signal for clearing data latched in the data latch circuit 303. Reference numeral 330 denotes an EPROM which stores the resistance values of the heating resistors 301, ink ejection characteristics, and the like of this heater board 100.

The operation of the printer apparatus using the print head with the above arrangement will be briefly described below.

After the power supply of the apparatus is turned on, the pre-heat pulse widths of the respective heating resistors 301 are determined in correspondence with the pre-measured ink ejection characteristics (the ink ejection amounts upon application of a predetermined pulse at a constant temperature) from respective ejection orifices (heating resistors) corresponding to the heater boards. The selection data (S1, S2) for selecting the determined pre-heat pulse widths corresponding to the respective ejection orifices are transferred to the shift register 304 in synchronism with shift clocks 104. Thereafter, a latch signal 108 is output to latch the selection data set in the shift register 304 into the selection data latch circuit 102. When a pre-heat operation is to be actually performed, in an example of FIG. 1, each four neighboring heating resistors 301 are pre-heated by the same pre-heat pulse signal selected by the selection circuit 101 based on the selection data (S1, S2). Note that the information of the above-mentioned ink ejection amount characteristics of the heater board 100 may be stored in the memory (EPROM) 330 on the heater board 100 of the print head or may be stored in the controller of the printer apparatus.

As described above, according to the heater board 100 of this embodiment, since a plurality of heating resistors 301 are pre-heated by an identical pre-heat pulse signal, the circuit scale of the selection data latch circuit 102 and the selection circuit 101 can be reduced. As indicated by a point A in FIG. 1, since the output from the shift register 304 is output to both the data latch circuit 303 for holding print data and the selection data latch circuit 102 for holding the selection data of the pre-heat pulse width, the shift register 304 for inputting the print data can be commonly used as a register for inputting the selection data for selecting the pre-heat pulse width. With this arrangement, a register for inputting the selection data of the pre-heat pulse width can be omitted, and an increase in circuit scale can be minimized even when, for example, a latch circuit having a large number of stages for holding the selection data is used.

Note that the selection data for determining the pre-heat pulse width need only be saved once upon, e.g., starting of the printer apparatus. Therefore, even when the apparatus has this function, the transfer sequence of print data to the print head can be performed in the same manner as in the conventional apparatus. In this case, in consideration of a change in the selection data stored in the selection data latch circuit 102 due to, e.g., noise, the selection data is preferably re-saved in the selection data latch circuit 102 in a non-print state.

The input operation of the pre- heat pulse signals 107 after the selection data for selecting the pre-heat pulse widths are held in the selection data latch circuit 102 will be explained below. This embodiment is characterized in that the heat pulse 308 and a plurality of pre-heat pulse signals 107 are independently set so as to change the ejection amount of an ink.

The width of the heat pulse 308 is determined to apply appropriate energy enough to eject an ink in correspondence with the resistance values of the heating resistors 301 by feeding back a signal from a resistance sensor 314 for monitoring the resistance values of the heating resistors 301 or from the EPROM 330. On the other hand, as for the pre-heat pulses, the selection data of the plurality of pre-heat pulse signals 107 is determined by the printer controller so as to change pre-heat pulse width and timing in correspondence with the temperature value detected by the temperature sensor 315. In this manner, the pre-heat pulses having various pulse widths can be applied to obtain a constant ink ejection amount from the respective nozzles even in a predetermined temperature state. On the other hand, when each pre-heat pulse width is set in correspondence with a factor other than the temperature, i.e., the ink-ejection amounts from ejection orifices (nozzles), the ink ejection amounts from all the ink ejection orifices can be set to be constant, thus eliminating density nonuniformity and stripes on a printed image. In this manner, a print operation can be performed by selecting none, one, or a plurality of pre-heat pulse signals using the selection data of the pre-heat pulse widths held in the selection data latch circuit 102. The operation of the circuit 102 will be described later with reference to FIGS. 3A to 4B.

Note that the number of the types of pre-heat pulses to be supplied to the heating resistors 301 can be further increased by modifying the selection method of the pre-heat pulse signals.

The selection data and the operation of the selection circuit 101 will be described below using a circuit 701 or 801 constituting the selection circuit 101 with reference to FIGS. 3A and 3B and FIGS. 4A and 4B.

Figure 3A:
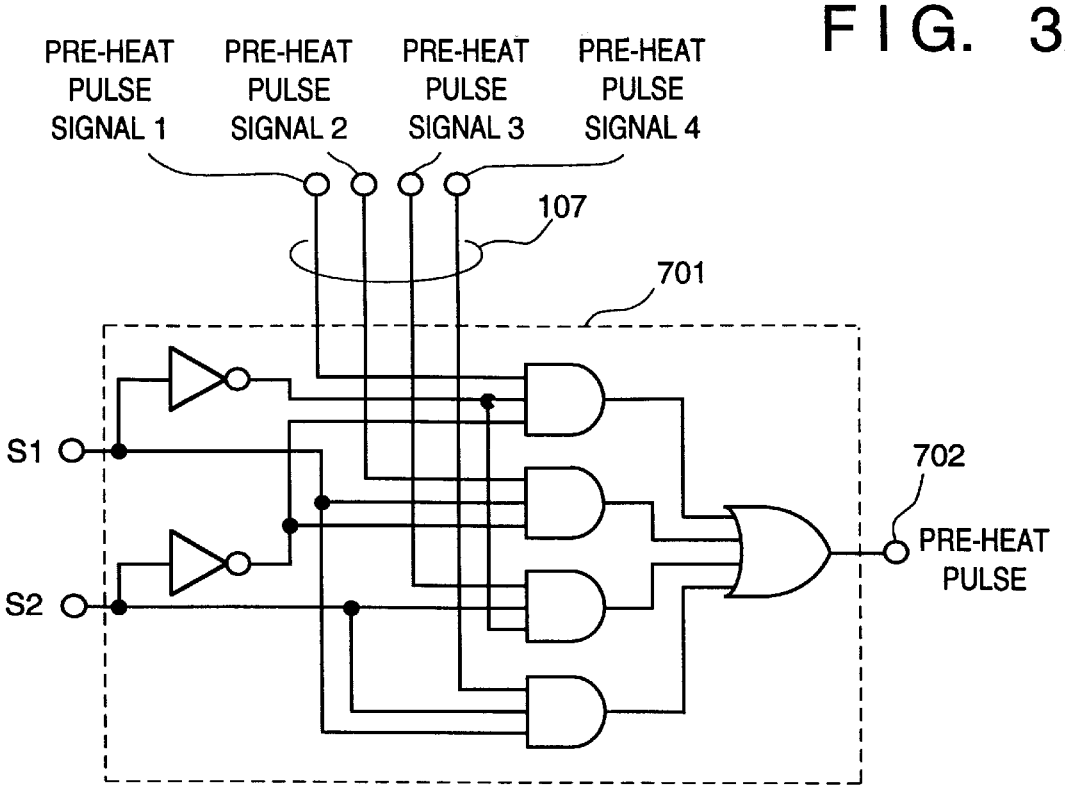
FIGS. 3A and 3B are respectively a circuit diagram showing an example of a pre-heat selection circuit and a timing chart showing the timing of the circuit in the first embodiment.
Figure 3B:
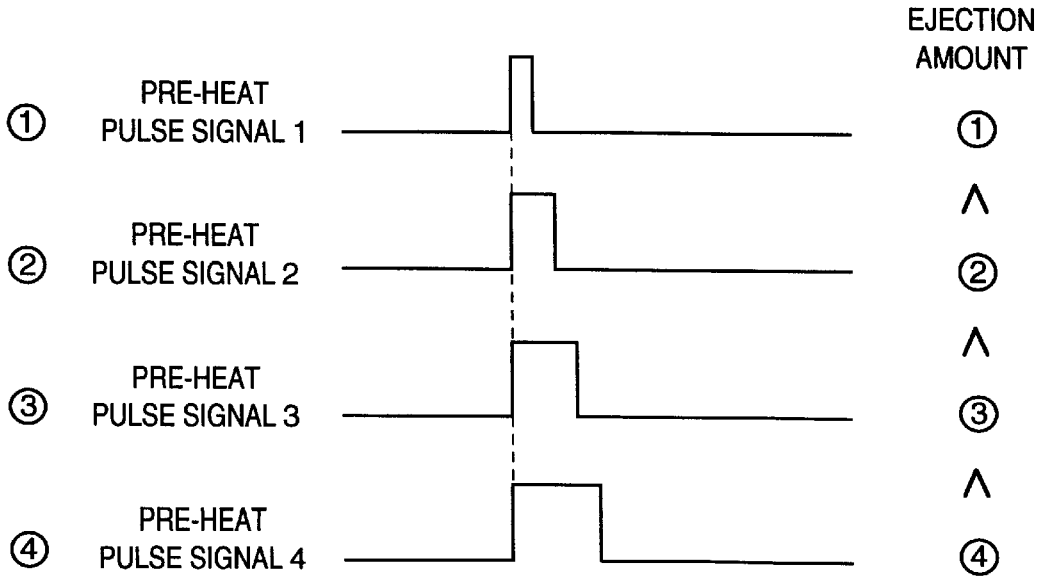

FIGS. 3A and 3B are views for explaining an example for supplying four different pre-heat pulses 702 to control the ink ejection amount in four levels. In FIGS. 3A and 3B, pre-heat pulses 1 to 4 are input as the pre-heat pulse signals 107.

FIG. 3A is a circuit diagram showing the arrangement of the selection circuit 701 for selecting a desired one of the pre-heat pulse signals 107, and FIG. 3B is a timing chart showing the selection timing. As can be seen from FIGS. 3A and 3B, when the selection data (S1, S2) output from the selection data latch circuit 102 is (0, 0), a pre-heat pulse signal 1 is selected; when the selection data (S1, S2) is (0, 1), a pre-heat pulse signal 2 is selected; and similarly, when the selection data (S1, S2) is (1, 1), a pre-heat pulse signal 4 is selected. The selected pre-heat pulse signal is output as a pre-heat pulse 702. Thus, the number of the pre-heat pulse signals 107 (in this case, 4) is equal to the number of pre-heat pulses 702 to be output.

Figure 4A:
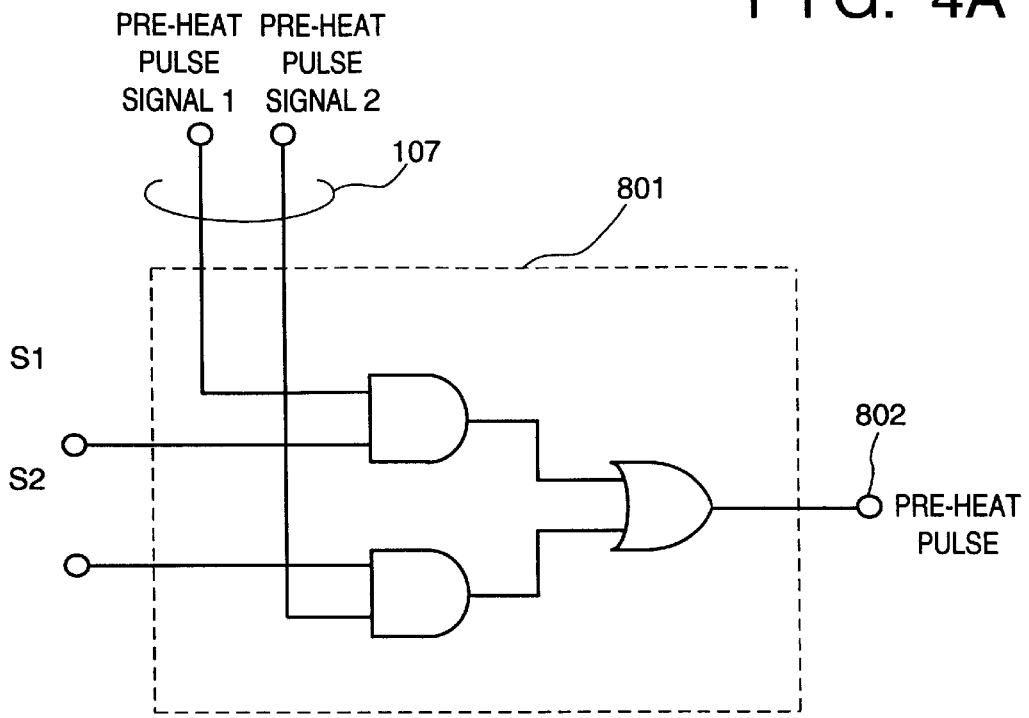
FIGS. 4A and 4B are respectively a circuit diagram showing another example of a pre-heat selection circuit and a timing chart showing the timing of the circuit in the first embodiment.
Figure 4B:
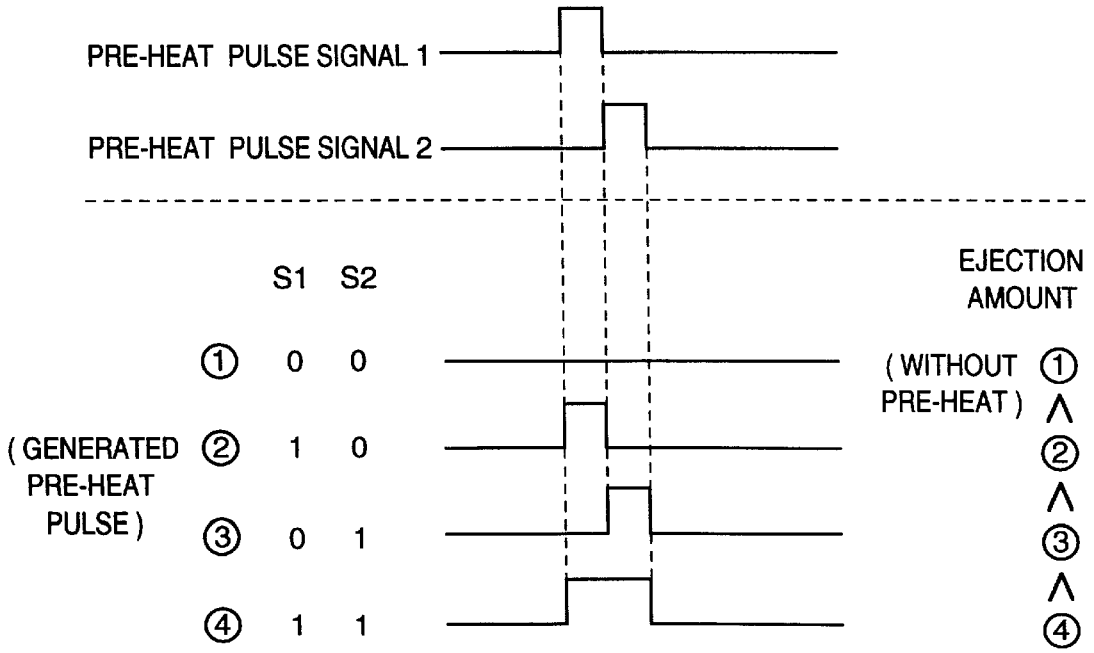

In contrast to this, in FIGS. 4A and 4B, the number of output pre-heat pulses 802 is four (including application of no pre-heat pulse) for the pre-heat pulse signals 1 and 2. More specifically, in the selection circuit 801 shown in FIG. 4A, when the selection data (S1, S2) is (0, 0), none of the pre-heat pulse signals 107 is selected; when the selection data (S1, S2) is (0, 1), a pre-heat pulse signal 1 is selected; when the selection data (S1, S2) is (1, 0), a pre-heat pulse signal 2 is selected; and when the selection data (S1, S2) is (1, 1), the sum of pre-heat pulse signals 1 and 2 of the pre-heat pulse signals 107 is selected. In this manner, the selected pre-heat pulse is output as a pre-heat pulse signal 802 (see FIG. 4B).

When the selection circuit shown in FIG. 4A is adopted, the circuit area on the heater board 100 can be reduced, and the size of the circuit board itself can be reduced without reducing the number of the types of pre-heat pulses. Thus, even when the number of pre-heat pulse signals 107 is three, a maximum of eight different pre-heat pulse 802 can be generated. In general, if the number of supplied pre-heat pulse signals 107 is P, the number of types of generated pre-heat pulse (the types of ejection amounts), P', can be a maximum of $2^P$.

When the print head with the above-mentioned arrangement is mounted in the ink-jet printer apparatus main body of this embodiment, and a print data is supplied to the print head, a high-speed, high-image quality print operation can be realized.

Figure 2:
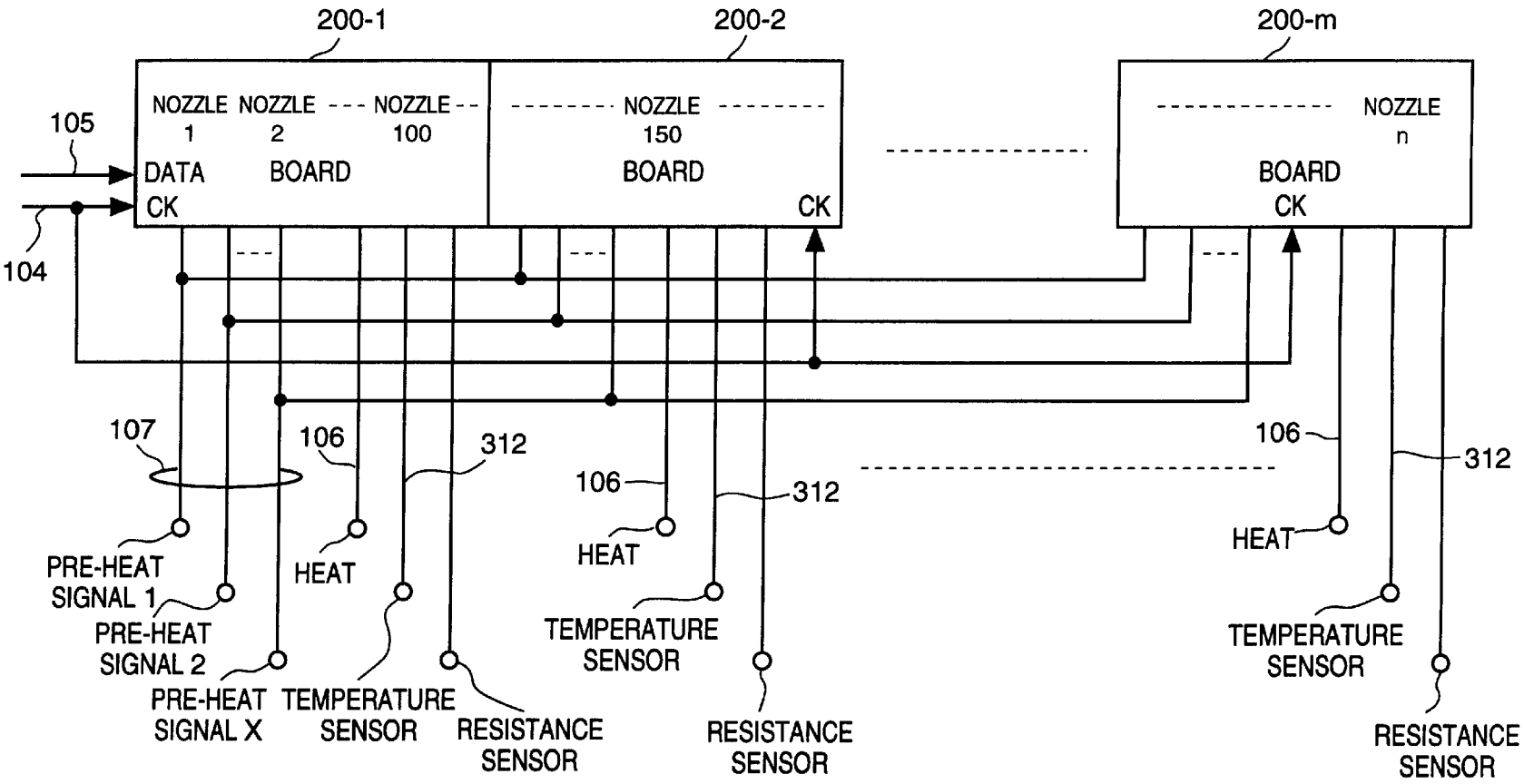
FIG. 2 is a diagram showing the arrangement of an ink-jet print head of the first embodiment.

FIG. 2 is a block diagram showing the arrangement of a multi-nozzle print head IJH constituted by arranging a plurality of heater boards 200-1 to 200-m (circuit boards). In FIG. 2, latch signals, heat pulse signals, and the like of the respective heater boards are not shown.

In this case, a print head having a total number of nozzles=n is realized using m heater boards 200-1 to 200-m. Note that the data input signal 105 of the heater board 200-2 is connected to the shift-output signal 116 of the heater board 200-1, and similarly, the serial output 116 of each heater board is connected to the serial input signal 105 of a succeeding heater board.

The following description will be made while paying attention to nozzles 1 and 100 of the heater board 200-1 and nozzle 150 of the heater board 200-2.

Figure 5:
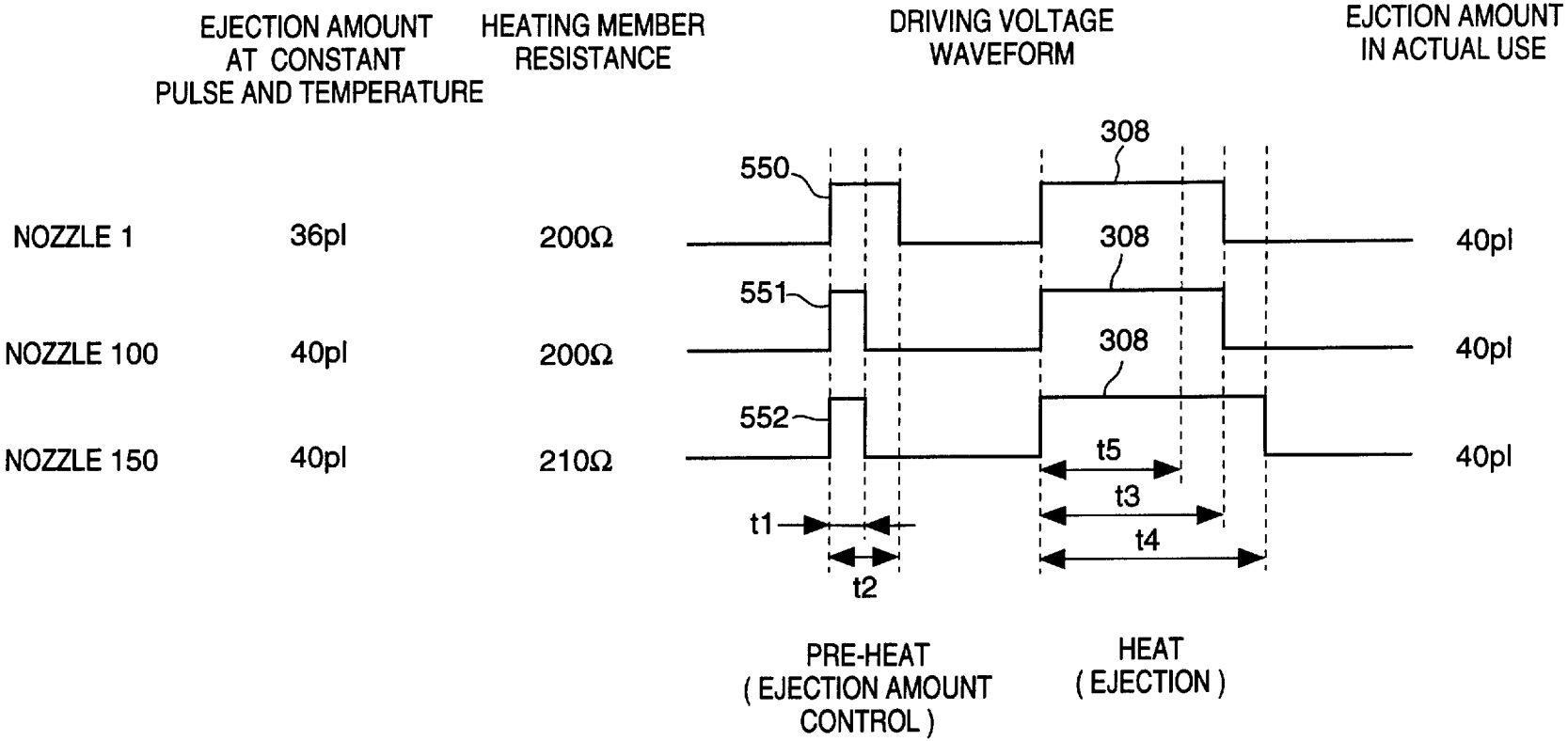
FIG. 5 is a view showing an example of the ink ejection amounts, pre-heat pulses, and heat pulses corresponding to the nozzles of the print head in the first embodiment.

Assume that the ink ejection amount of nozzle 1 is 36 pl (pico liter), the ink ejection amount of nozzle 100 is 40 pl, and the ink ejection amount of nozzle 150 is 40 pl at a constant temperature and upon application of a predetermined pulse width, as shown in FIG. 5. In this case, the selection data for nozzles 100 and 150 are set in the selection data latch circuit 102 to be (S1, S2)=(1, 0), as indicated by, e.g., in FIG. 4B. The selection data for nozzle 1 with a small ejection amount is set to be (S1, S2)=(1, 1), as indicated by, e.g., in FIG. 4B. As for the heat pulse 308, since it has already been detected based on the signal from the resistance sensor 314 or the EPROM 330 that the resistance of the heater board 200-1 is 200 Ω and that of the heater board 200-2 is 210 Ω, the width of the heat pulse to be applied to the heater board 200-2 is set to be larger than that of the heat pulse 308 to be applied to the heater board 200-1, so that almost constant energies are applied to the heater boards 200-1 and 200-2, thereby driving the heating resistors 301. FIG. 5 shows the driving current waveforms obtained when the heating resistors are driven under the abovementioned condition.

As can be seen from FIG. 5, the width of the pre-heat pulse 550 for nozzle 1 with a small ejection amount is set to be larger than those of the pre-heat pulses 551, 552 for nozzles 100 and 150 (t1<t2). As for the heat pulse 308, the width, t4, of the heat pulse 308 for nozzle 150 is set to be larger than the width t3) for the nozzles of the heater board 200-1 (t4>t3). In FIG. 5, t5 indicates the minimum heat pulse width required for forming bubbles in an ink and flying an ink droplet, and the relationship (t1, t2<t5<t3, t4) holds.

As described above, according to this embodiment, since the pre-heat pulse widths are changed under the condition satisfying (t1<t2) and (t1, t2<t5) with respect to a change in temperatures of the heater boards, the ink ejection amounts from the respective nozzles can be always set to be about 40 pl. Thus, an image with very high quality, which is free from any density nonuniformity and generation of stripes, can be printed. Furthermore, as for the heat pulses 308, since the heat pulse widths are adjusted in correspondence with the resistance values of the heating resistors 301 of the respective heater boards, predetermined energy can be applied without difficulty, and a long service life of the heating resistors can also be assured.

Figure 6:
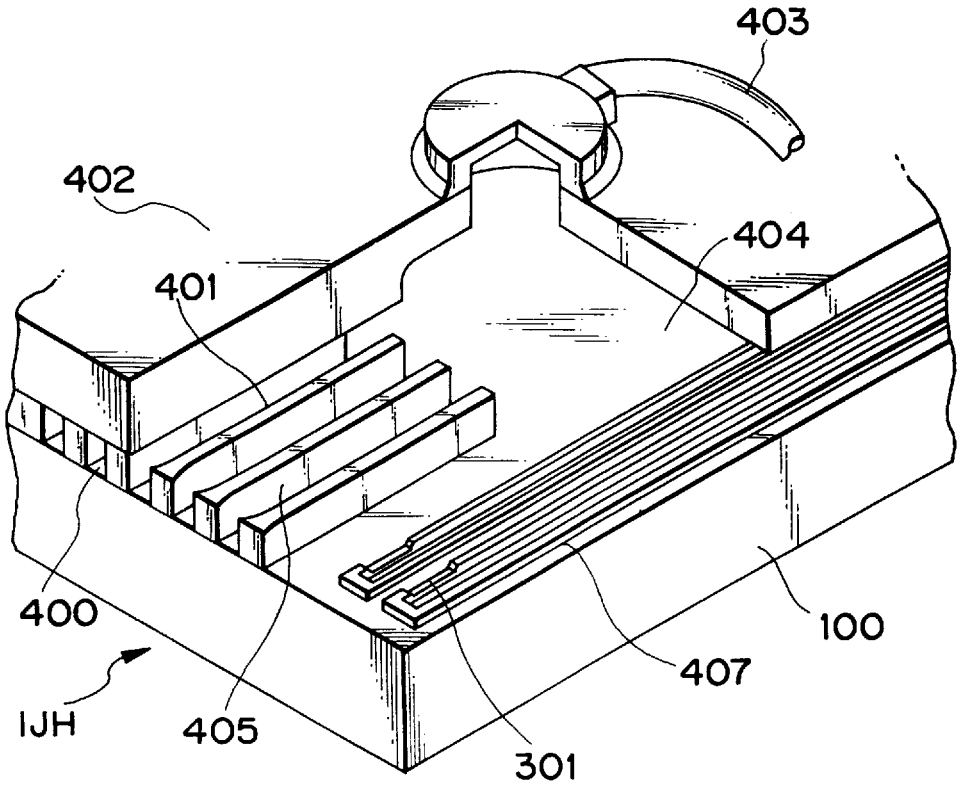
FIG. 6 is a partially cutaway perspective view showing the arrangement of the print head of the first embodiment.

FIG. 6 shows the structure of the print head of this embodiment. The same reference numerals in FIG. 6 denote the same parts as in FIG. 1.

Referring to FIG. 6, channel wall members 401 for defining ink channels 405 communicating with a plurality of ejection orifices 400, and a top plate 402 with an ink supply port 403 are attached. An ink supplied from the ink supply port 403 is stored in an inner common ink chamber 404, and is then supplied to the respective ink channels 405. When the heating resistors 301 on the heater board 100 are energized and driven in this state in correspondence with print data, ink droplets are ejected from the ejection orifices 400, thus achieving a print operation. Note that reference numeral 407 denotes wiring lines.

Figure 7:
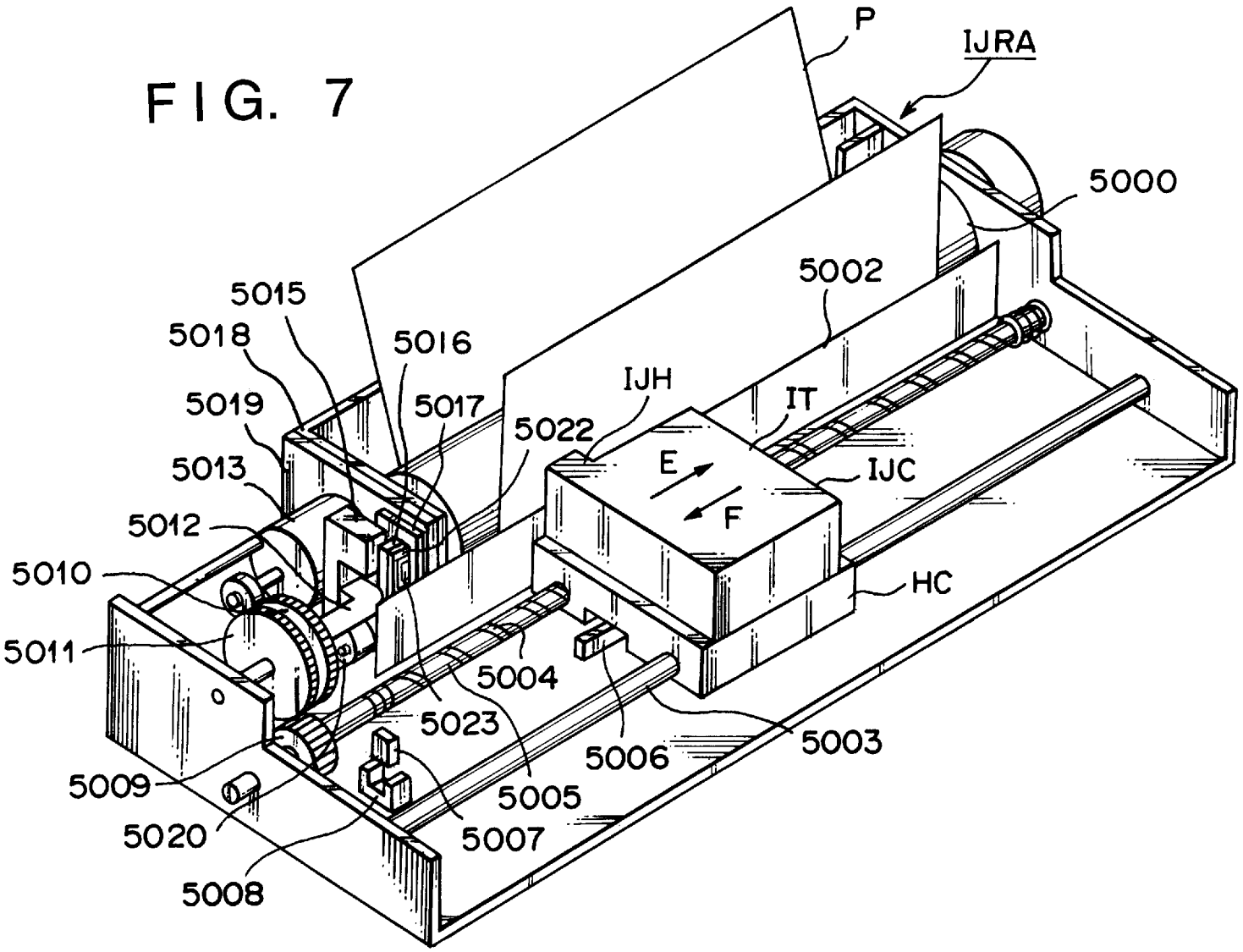
FIG. 7 is a perspective view showing the outer appearance of principal part of the ink-jet printer apparatus of the first embodiment.

FIG. 7 is a schematic perspective view of an ink-jet printer apparatus IJRA which mounts the print head IJH of this embodiment to perform a print operation.

Referring to FIG. 7, a carriage HC engages with a spiral screw 5004 of a lead screw 5005, which rotates via driving force transmission gears 5011 and 5009 in synchronism with the forward/reverse rotation of a carrier motor 5013. The carriage HC has a lever 5006 and reciprocally moves in the directions of arrows E and F in FIG. 7. The carriage HC carries an ink-jet cartridge IJC. Reference numeral 5002 denotes a paper pressing plate, which presses a paper sheet against a platen 5000 across the moving direction of the carriage HC. Reference numerals 5007 and 5008 denote photocouplers, which serve as home position detection means for confirming the presence of the lever 5006 of the carriage HC in a corresponding region, and switching, e.g., the direction of rotation of the carrier motor 5013. Reference numeral 5016 denotes a member for supporting a cap member 5022 for capping the front surface of the print head IJH; and 5015, a suction means for drawing ink through the interior of the cap member 5022 by suction. The suction means 5015 performs recovery of the print head IJH via an intra-cap opening 5023. Reference numeral 5017 denotes a cleaning blade; and 5019, a member for movably supporting the blade in the back-and-forth direction. These members 5017 and 5019 are supported on a main body support plate 5018. The present invention is not limited to this blade, but a known cleaning blade may be applied to this embodiment. Reference numeral 5012 denotes a lever for initiating a suction operation of the suction recovery. The lever 5012 moves upon movement of a cam 5020 which engages with the carriage HC, and its movement control is attained by known transmission means such as clutch switching on the basis of the driving force from the driving motor.

These capping, cleaning, and suction recovery means are arranged to perform desired processing at their corresponding positions upon operation of the lead screw 5005 when the carriage HC reaches a region on the home-position side. However, the present invention is not limited to such timings as long as desired operations can be performed at known timings.

<Description of Control Arrangement>

Figure 8:
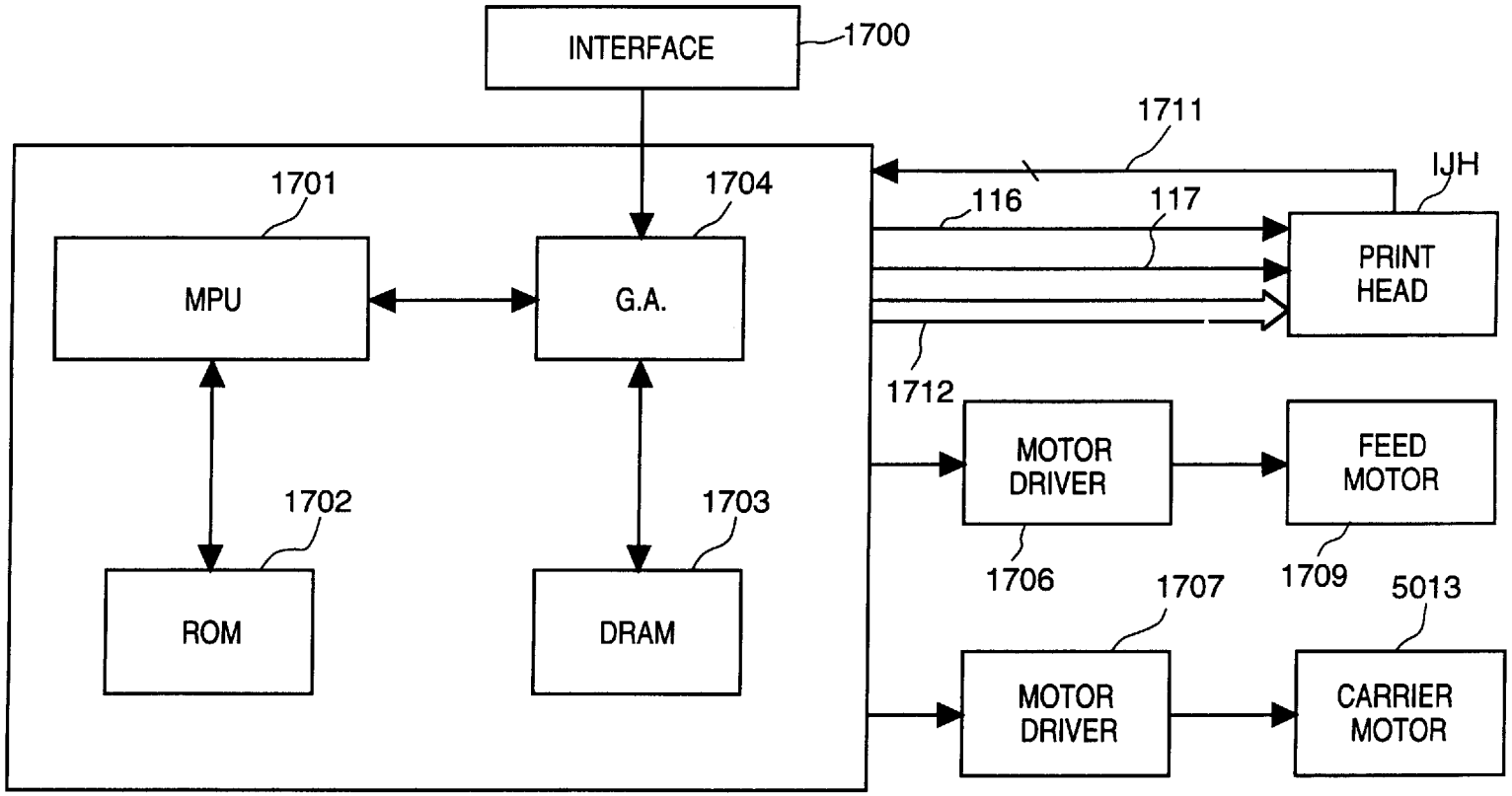
FIG. 8 is a schematic block diagram showing the arrangement of the printer apparatus shown in FIG. 6.

The control arrangement for executing the print control of the above-mentioned apparatus will be described below with reference to the block diagram shown in FIG. 8. Referring to FIG. 8 showing a control circuit, reference numeral 1700 denotes an interface for inputting a print signal; 1701, an MPU; 1702, a program ROM for storing a control program executed by the MPU 1701; and 1703, a dynamic RAM for storing various data (the print signal, print data to be supplied to the head, and the like). Reference numeral 1704 denotes a gate array for performing supply control of print data to the print head IJH. The gate array 1704 also performs data transfer control among the interface 1700, the MPU 1701, and the RAM 1703. Reference numeral 5013 denotes a driving motor for moving the print head IJH; and 1709, a feed motor for feeding a recording sheet. Reference numerals 1706 and 1707 denote motor drivers for respectively driving the feed motor 1709 and the carrier motor 5013. Reference numeral 1711 denotes signal lines for monitoring signals from the sensors 314 on the respective heater boards; and 1712, signal lines including the pre-heat pulse signals (107), latch signals (108, 307), heat pulse (main heat pulse) signals (308), and the like.

Figure 9:
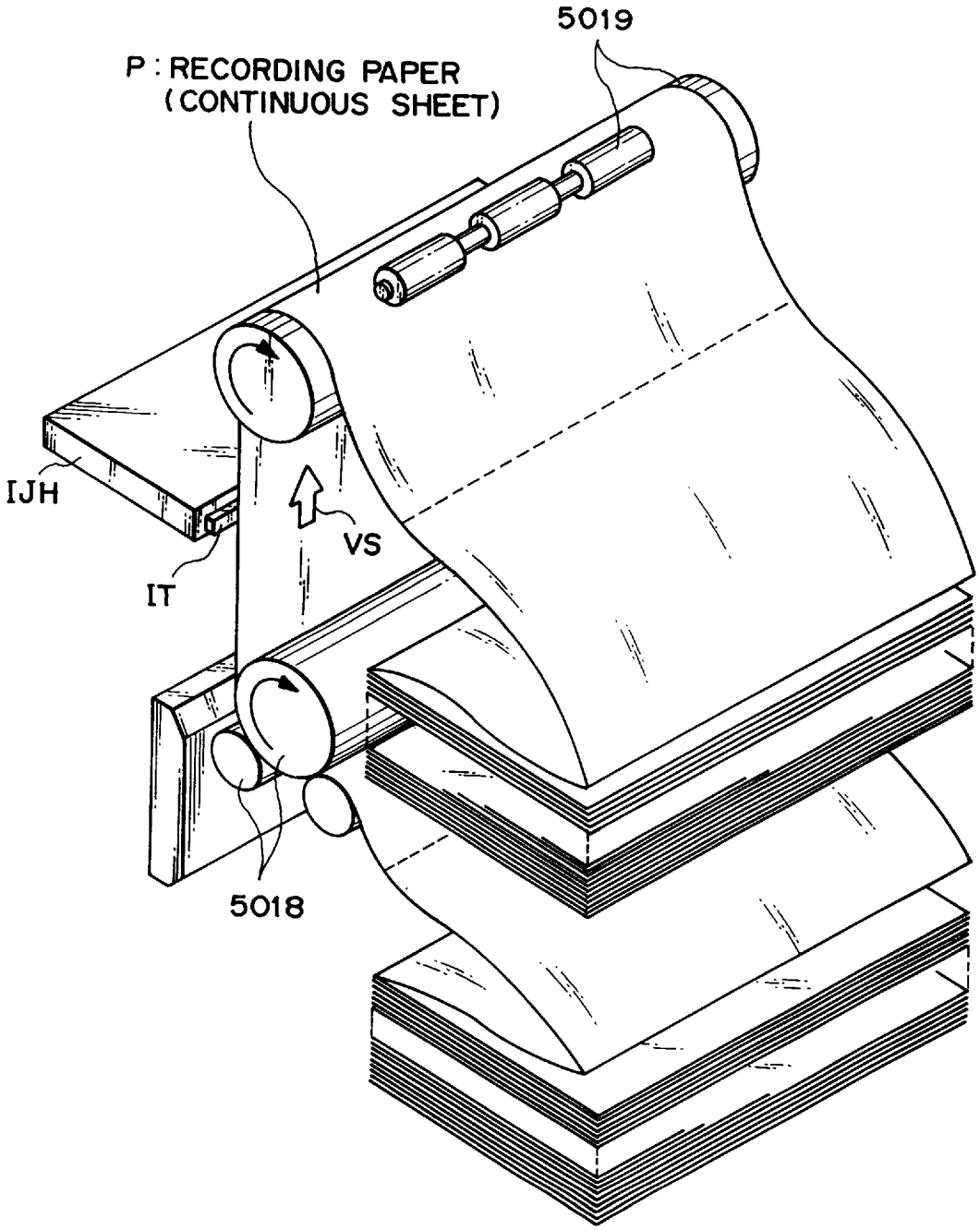
FIG. 9 is a perspective view showing the outer appearance of print principal part of an ink-jet printer apparatus using a full-line type ink-jet head.

FIG. 9 is a perspective view showing the outer appearance of the arrangement of principal part of an ink-jet printer IJRA comprising a full line-type ink-jet head as a typical embodiment of the present invention.

The ink-jet printer of this embodiment has an arrangement in which print heads (full-line multi-nozzle recording head) IJH for ejecting ink droplets in a range corresponding to the width of recording paper (continuous sheet) P are arranged in the feed direction of the recording paper, as shown in FIG. 9. Ink droplets are ejected from ejection orifices IT of these print heads IJH toward the recording paper P at predetermined timings.

In this embodiment, the recording paper P as a foldable continuous sheet is conveyed in the direction of an arrow VS shown in FIG. 9 by driving the feed motor 1709 under the control of the control circuit (to be described below), thus printing an image on the recording paper. In FIG. 9, reference numeral 5018 denotes sheet feed rollers; and 5019, exhaust-side rollers which hold the recording paper P as a continuous sheet at the print position together with the sheet feed rollers 5018, and feed the recording paper P in the direction of the arrow VS in cooperation with the sheet feed rollers 5018 driven by the feed motor 1709.

Note that the arrangement of this ink-jet printer is substantially the same as that shown in FIG. 8, except that the carrier motor 5013 in the block diagram shown in FIG. 8 is not included in this arrangement. Thus, a detailed description thereof will be omitted.

Figure 10:
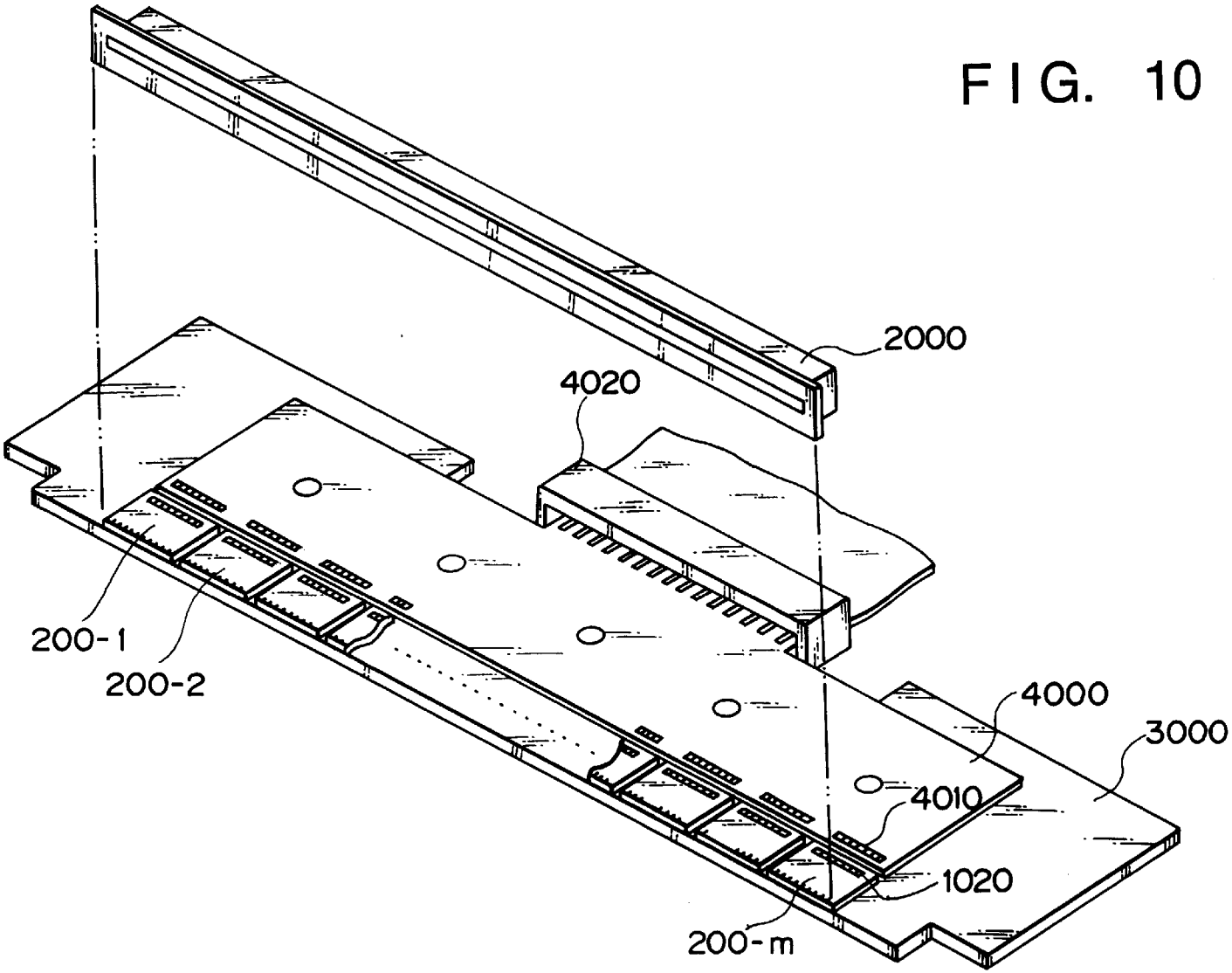
FIG. 10 is a perspective view showing the outer appearance of the full-line type ink-jet head.

FIG. 10 is an exploded perspective view for explaining the arrangement of a full-line type print head of this embodiment. A case will be exemplified below wherein a print element corresponds to an ejection energy generation element used for ink ejection (in the print method of this embodiment, a pair of electrodes and a heating resistor arranged between these electrodes).

According to the ink-jet head of this embodiment, since an elongated (full-line) print head which is conventionally formed by, e.g., a photolithography technique over the full-line width is constituted by a plurality of heater boards, the print head can be formed with a very high yield. In addition, an integral top plate which has a plurality of ink ejection orifices formed at one end portion of the plate, and a plurality of grooves communicating with the ejection orifices and extending from one end portion toward the other end portion of the plate is joined so that the plurality of grooves are closed by the boards. Thus, an elongated (full-line) ink-jet print head unit can be very easily constituted.

In this embodiment, the ink-jet print head in which the ink ejection orifice density is 360 dpi (70.5-$\mu$m intervals) and the number of ink ejection orifices is 3,008 nozzles (the print width=212 mm) will be explained.

Referring to FIG. 10, 128 heating resistors 301 (FIG. 1) for generating ejection energy are arranged at predetermined positions at a density of 360 dpi on each of the heater boards 200-1 to 200-m. The heater boards 200-1 to 200-m are adhered and fixed on the surface of a base plate 3000 consisting of a material, e.g., a metal, ceramics, or the like, so that a plurality of heater boards are juxtaposed. Also, a wiring board 4000 is adhered and fixed on the base plate 3000 in the same manner as the heater boards 200-1 to 200-m. In this case, the wiring board 4000 is adhered and fixed on the base plate 3000, so that power pads 1020 on the heater boards 200-1 to 200-m are located in the vicinity of signal/power supply pads arranged on the wiring board 4000. The wiring board 4000 has a connector 4020 for receiving various signals such as a print signal, pre-heat signals, and the like, and driving electric power from an external circuit.

Figure 11:
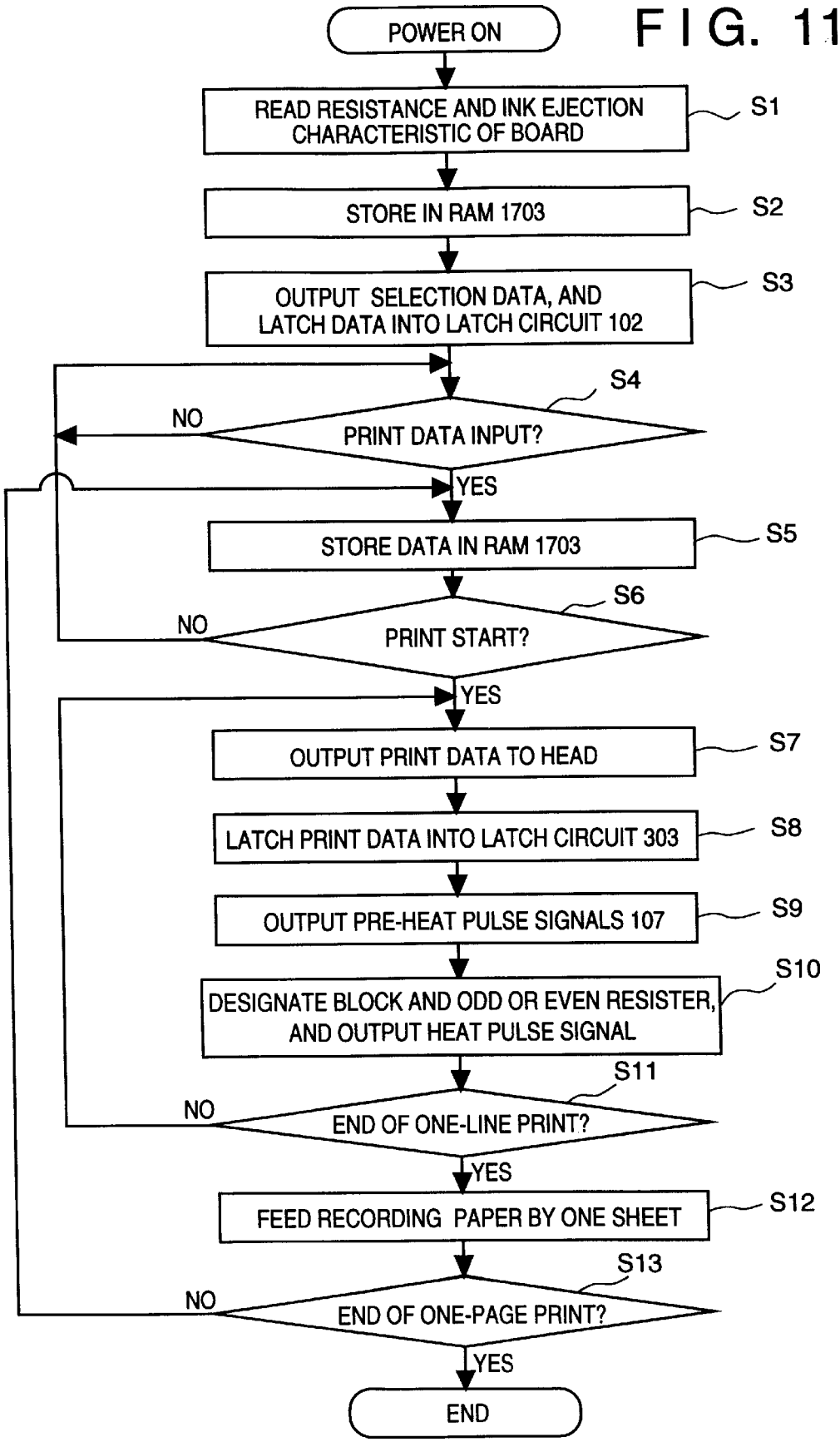
FIG. 11 is a flow chart showing the print processing in the ink-jet printer apparatus of the first embodiment.

FIG. 11 is a flow chart showing the processing from the power-ON operation until the end of a print operation for one page in the ink-jet printer apparatus of this embodiment. The control program for executing this processing is stored in the ROM 1702 (FIG. 8), and is executed under the control of the MPU 1701.

The processing shown in FIG. 11 is started when the power supply of the apparatus is turned on. In step S1, the resistance values of the heating resistors 301 on each of the heater boards (m boards) of the print head IJH and the ink ejection amount characteristics of the respective nozzles (ejection orifices) on each of the heater boards are read. In step S2, the read data are stored in the RAM 1703. Note that the resistance values of these heating resistors 301 can be detected by the resistance sensors 314 or read from the EPROM 330 (in FIG. 12), and the ink ejection amount characteristics of the respective nozzles may be stored in, e.g., the memories (EPROMs) 330 arranged on each of the heater boards of the print head. In step S3, the above-mentioned selection data (S1, S2) for each heater board is determined in correspondence with the resistance value of the heating resistors 301 and the ink ejection amount characteristic of each of the heater boards, is serially transferred to the shift registers 304 of the respective heater boards, and is then latched by the selection data latch circuits 102 of the respective heater boards by outputting the latch signal 108.

The flow then advances to step S4 to check if print signals are input from an external apparatus (host computer; not shown) via the interface 1700. If YES in step S4, the flow advances to step S5 and the received print signals are stored in the RAM 1703. The flow then advances to step S6 to check if the apparatus is ready to start, e.g., a print operation for one line. If NO in step S6, the flow returns to step S4; otherwise, the flow advances to step S7.

In step S7, print data to be printed in the first line is serially transferred to the shift registers 304. The flow advances to step S8, and the latch signal 307 is output to latch the print data in the data latch circuits 303 on the respective heater boards. The flow advances to step S9, and the pre-heat pulse signals 107 are output. In response to the pre-heat pulse signals 107, each selection circuit 101 in each heater board selects one or several of the pre-heat signals 107 in correspondence with the selection data latched in the selection data latch circuit 102, and a pre-heat pulse is output via the OR gate 112. In this embodiment, four neighboring heating resistors 301 are pre-heated by the same pre-heat pulse. As shown in, e.g., FIGS. 3A and 3B or FIGS. 4A and 4B above, the pulse width of the pre-heat pulse is determined in correspondence with the selection data from the selection data latch circuit 102 to pre-heat the print head.

The flow then advances to step S10, and the block selection signal 115 for indicating a block to be selected of the heating resistors 301, and the signals 117 and 118 for indicating the odd- or even-numbered heating resistors to be energized are output to the respective heater boards. Thereafter, the heat pulse 308 is output to actually print an image. This energization control is performed for all the blocks of the heating resistors 301, and upon completion of energization of all the heating resistors 301 on the respective heater boards, an image print operation for one line by the print head IJH is completed.

During the pre-heat operation or the energization (heat) processing of the heating resistors 301 for an actual print operation, data reception from the host computer and transfer of print data for the next line to the shift registers 304 of the respective heater boards are performed. When the print head IJH is constituted by a plurality of heater boards, as shown in FIGS. 2 and 10, the heating resistors 301 on the respective heater boards may be energized in turn in units of heater boards in step S10 in place of simultaneously energizing the heating resistors 301 on all the heater boards. With this control, the power supply capacity of the apparatus can be reduced. In step S11, it is checked if the print operation for one line is completed. If NO in step S11, the flow returns to step S7 to execute the above-mentioned processing.

Upon completion of the print processing for one line, the flow advances from step S11 to step S12, and the feed motor 1709 is driven to feed the recording paper by one line in the sub-scanning direction. In step S13, it is checked if a print operation for one page is completed. If NO in step S13, the flow returns to step S6 to check if reception of print data for the next line is completed. When the print operation of an image for one page is completed by repeating the above-mentioned operation, this print processing ends. In FIG. 9, when a plurality of print heads IJH for ejecting inks of different colors are prepared, a color recording apparatus can be easily realized.

<Second Embodiment>

Figure 13:
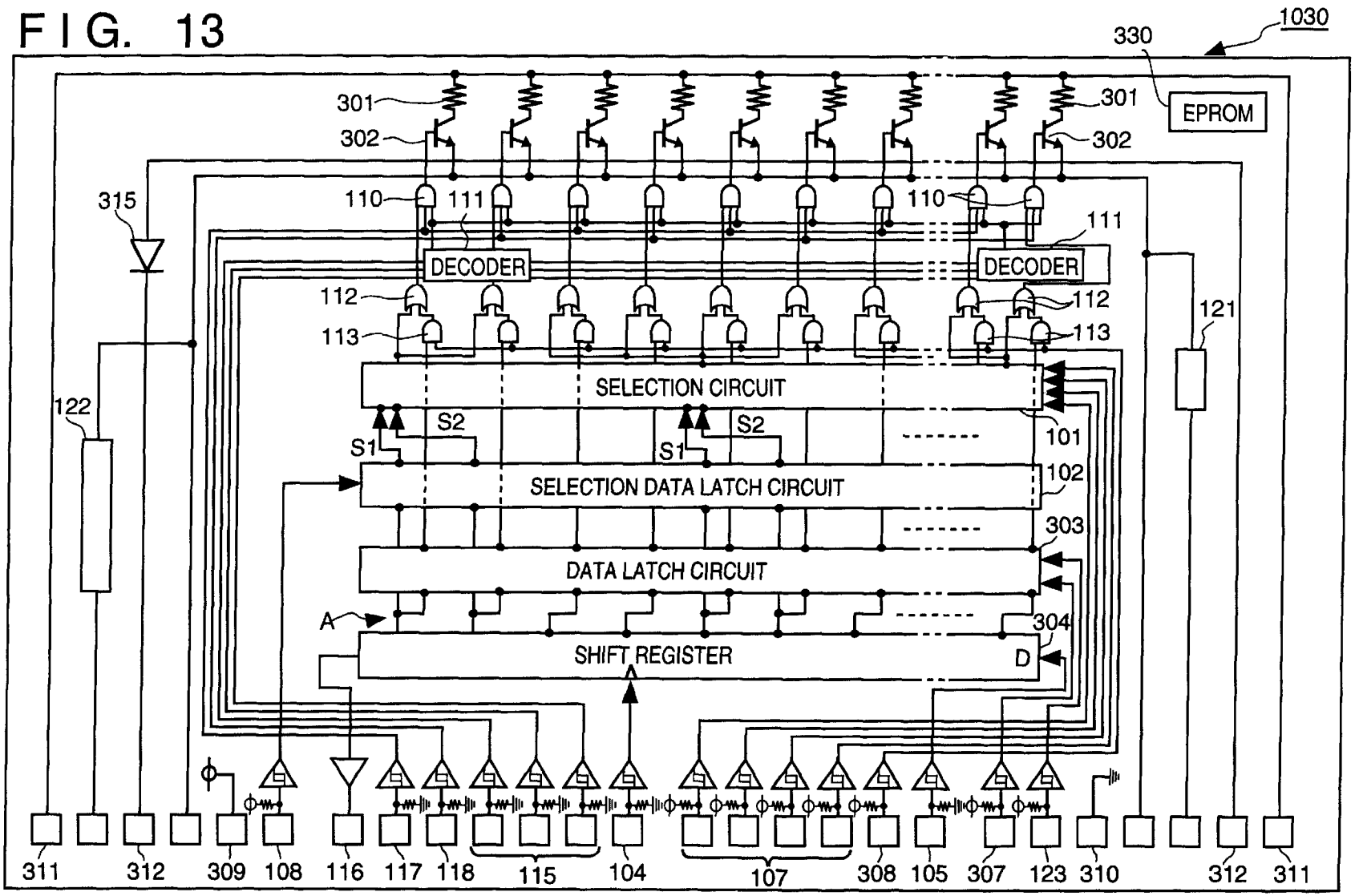
FIG. 13 is a block diagram of an ink-jet print head board according to the second embodiment of the present invention.

FIG. 13 is a block diagram showing the arrangement of a heater board 1300 for an ink-jet head according to the second embodiment of the present invention. The same reference numerals in FIG. 13 denote the same parts as in FIG. 1 above, and a detailed description thereof will be omitted.

In this embodiment, as the same as the first embodiment, a heat signal 308 and a plurality of pre-heat signals 107 are input from different terminals, and a driving signal is simultaneously applied from one OR gate 112 to each of the plurality of power transistors 302 and the plurality of heating resistors 301. At the two end portions of each of the plurality of heating resistors 301 on a single heater board, for example, on adjacent heater boards 200-1 and 200-2 shown in FIG. 2, two heating resistors in the vicinity of the right end of the heater board 200-1 and two heating resistors in the vicinity of the left end of the heater board 200-2 (a total of four resistors) are pre-heated by the same pre-heat pulse, and other heating resistors are simultaneously pre-heated in units of four resistors. The number of heating resistors 301 to be pre-heated is set to satisfy (the number of the heating resistors in the vicinity of the end portion < the number of other heating resistors), e.g., (1<2) or (2<4). In the example shown in FIG. 13, (2<4) is satisfied.

In the case of the multi-nozzle head constituted by arranging a plurality of heater boards, as shown in, e.g., FIG. 2, print nonuniformity is most conspicuous near the joint between adjacent heater boards, but is not so conspicuous on portions other than the joint. For this reason, the number of heating resistors 301 to be simultaneously energized in a pre-heat mode in the vicinity of the two end portions on the heater board is set to be different from that for other portions. Since print nonuniformity for four or eight pixels can be naturally removed at the same time, print nonuniformity can be corrected on the entire printed image, and size and cost reductions of the circuit and boards can be realized.

In the above description, the heater board is adopted in the ink-jet print head. However, the present invention is not limited to this. For example, the present invention may be applied to a heater board for a thermal head.

The present invention has exemplified a printer system, which comprises means (e.g., an electro-thermal conversion element, laser beam, and the like) for generating heat energy as energy utilized upon execution of ink ejection, and causes a change in state of an ink by the heat energy, among the ink-jet printing systems. According to this system, a high-density, high-definition printing operation can be attained.

As the representative arrangement and principle of the ink-jet printing system, one practiced by use of the basic principle disclosed in, for example, U.S. Pat. Nos. 4,723,129 and 4,740,796 is preferred. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleus boiling, to each of electro-thermal conversion elements arranged in correspondence with a sheet or liquid channels holding a liquid (ink), heat energy is generated by the electro-thermal conversion element to effect film boiling on the heat acting surface of the print head, and consequently, a bubble can be formed in the liquid (ink) in one-to-one correspondence with the driving signal. By ejecting the liquid (ink) through an ejection opening by growth and shrinkage of the bubble, at least one droplet is formed. If the driving signal is applied as a pulse signal, the growth and shrinkage of the bubble can be attained instantly and adequately to achieve ejection of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the print head, in addition to the arrangement as a combination of ejection orifices, liquid channels, and electro-thermal conversion elements (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slit common to a plurality of electro-thermal conversion elements as an ejection portion of the electro-thermal conversion elements, or Japanese Patent Laid-Open No. 59-138461 which discloses the arrangement having an opening for absorbing a pressure wave of heat energy in correspondence with an ejection portion.

Furthermore, as a full line type print head having a length corresponding to the width of a maximum recording medium which can be printed by the printer, either the arrangement which satisfies the full-line length by combining a plurality of print heads as disclosed in the above specification or the arrangement as a single print head obtained by forming print heads integrally can be used.

In addition, the present invention is effective for a case using an exchangeable chip type print head which can be electrically connected to the apparatus main body or can receive an ink from the apparatus main body upon being mounted on the apparatus main body, or a cartridge type print head in which an ink tank is integrally arranged on the print head itself.

It is preferable to add recovery means for the print head, preliminary auxiliary means, and the like provided as an arrangement of the print apparatus of the present invention since the effect of the present invention can be further stabilized. Examples of such means include, for the print head, capping means, cleaning means, pressurization or suction means, and preliminary heating means using electro-thermal conversion elements, another heating element, or a combination thereof. It is also effective for stable printing to execute a preliminary ejection mode which performs ejection independently of printing.

Furthermore, as a printing mode of the print apparatus, the present invention is effective for not only an apparatus having a printing mode using only a primary color such as black or the like, but also an apparatus having at least one of a multi-color mode using a plurality of different colors or a full-color mode achieved by color mixing, although such modes may be attained either by using an integrated print head or by combining a plurality of print heads.

Moreover, in each of the above-mentioned embodiments, an ink is described as a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable ejection range. In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, the present invention can be applied to a case wherein an ink which liquefies upon application of heat energy, such as an ink which liquefies upon application of heat energy according to a printing signal and is ejected in a liquid state, an ink which begins to solidify when it reaches a recording medium, or the like, is used. In this case, an ink may oppose electro-thermal conversion elements while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

Note that the present invention may be applied to either a system constituted by a plurality of devices or an apparatus consisting of a single device. Also, the present invention may be applied to a case wherein the invention is attained by supplying a program for practicing the present invention to the system or apparatus.

As described above, according to this embodiment, the heat pulse and the plurality of pre-heat pulse signals are separately supplied to each of the heater boards for a print head, the pre-heat pulse signal is selected by the selection data latched in the selection data latch circuit 102 arranged in the heater board, and the heat pulse is synthesized with an image ejection pulse (AND of the heat pulse and print data). With this arrangement, since a conventional shift register 304 can be effectively utilized, an increase in element space for inputting selection data can be prevented.

Ejection amount control for respective nozzles can be realized, and at the same time, even in a print head constituted by a plurality of heater boards, constant input power can be obtained.

Furthermore, since the ejection amount control for respective nozzles is simultaneously performed in units of a plurality of bits, the circuit can be rendered compact, and as a result, a compact heater board can be realized. Thus, a cost reduction of the apparatus can be attained, and a long-life ink-jet print head which has a constant ejection amount and is free from density nonuniformity and generation of stripes, and a print apparatus using the print head can be provided.

The present invention can be applied to a system constituted by a plurality of devices or to an apparatus comprising a single device.

Furthermore, the invention is applicable also to a case where the invention is embodied by supplying a program to a system or apparatus. In this case, a storage medium, storing a program according to the invention constitutes the invention. The system or apparatus installed with the program read from the medium realizes the functions according to the invention.

The present invention is not limited to the above embodiments and various changes and modifications can be made within the spirit and scope of the present invention. Therefore, to apprise the public of the scope of the present invention, the following claims are made.

What is claimed is:

1. A print head having energization members for driving a plurality of print elements and a circuit for energizing the energization members in correspondence with print data to perform a print operation, comprising:

input terminals for inputting a plurality of pulse signals used for pre-heating the print elements;

a storage circuit for receiving and storing selection information for selecting one of the plurality of pulse signals input from said input terminals; and driving circuits, each of which selects one of the plurality of pulse signals input from said input terminals in accordance with the selection information stored in said storage circuit, and applies the selected pulse signal to at least two energization member units to pre-heat the print elements.

2. The print head according to claim 1, wherein each of said driving circuits comprises an AND gate for logically ANDing the print data and an energization signal, and an OR gate for receiving an output from said AND gate and the selected pre-heat pulse signal.

3. The print head according to claim 1, wherein the selection information and print data are commonly input to a shift register for receiving and holding serial data.

4. The print head according to claim 1, wherein one of the plurality of pulse signals is selected so that if the number of pulse signals is P, the number of types of selected and generated pre-heat pulses satisfies a condition ($P \leqq P' \leqq 2P$).

5. A print method for printing an image on a recording medium by energizing and driving a print head of claim 1, comprising the steps of:

determining selection information on the basis of a print characteristic of said print head;

transferring the selection information to said print head, and storing the selection information in the storage circuit;

outputting a plurality of pre-heat pulse signals to said print head prior to a print operation; and energizing the energization members of said print head in accordance with image data so as to perform a print operation after preliminary energization of said print head.

6. A print apparatus for printing an image on a recording medium by energizing and driving a print head, said print head having energization members for driving a plurality of print elements, input terminals for inputting a plurality of pre-heat pulse signals to said energization members, a storage circuit for receiving and storing selection information for selecting one of the plurality of pre-heat pulse signals input from said input terminals, and driving circuits, each of which selects one of the plurality of pre-heat pulse signals input from said input terminals in accordance with the selection information stored in said storage circuit and applies the selected pre-heat pulse signal to at least two energization members, said apparatus comprising:

characteristic information storage means for storing print characteristics of said print elements of said print head;

transfer means for determining the selection information on the basis of the print characteristics stored in said characteristic storage information storage means, and transferring the determined selection information to said print head;

preliminary energization means for pre-heating at least two print elements by outputting the plurality of pulse signals to said print head prior to a print operation; and print energization means for energizing said energization members of said print head so as to perform the print operation after the pre-heating operation by said preliminary energization means.

7. The apparatus according to claim 6, wherein each of said driving circuits comprises an AND gate for logically ANDing the print data and an energization signal, and an OR gate for receiving an output from said AND gate and the selected pre-heat pulse signal.

8. The apparatus according to claim 6, wherein the selection information and print data are commonly input to a shift register for receiving and holding serial data.

9. The apparatus according to claim 6, wherein one of the plurality of pre-heat pulse signals is selected so that if the number of pre-heat pulse signals is P, the number of types of selected and generated pre-heat pulses satisfies a condition ($P \leqq P' \leqq 2P$).

10. The apparatus according to claim 6, wherein said apparatus has a plurality of said print heads for respectively ejecting inks of different colors.

11. A print head constituted by using a plurality of boards each having energization members for driving a plurality of print elements and a circuit for energizing the energization members in correspondence with print data to perform a print operation, wherein each of the boards comprises input terminals for inputting a plurality of pre-heat pulse signals to the energization members, a storage circuit for receiving and storing selection information for selecting one of the plurality of pulse signals input from said input terminals, and driving circuits, each of which selects one of the plurality of pre-heat pulse signals input from said input terminals in accordance with the selection information stored in said storage circuit and applies the selected pre-heat pulse signal to at least two energization member units to pre-heat the print elements.

12. The print head according to claim 11, wherein each of said driving circuits preform a pre-heat operation in units of two adjacent print elements near each of two ends of the plurality of print elements on each of the boards, and in units of a plurality of blocks obtained by dividing the plurality of remaining print elements, and each of the plurality of blocks includes at least two print elements.

13. The print head according to claim 11, wherein said driving circuit comprises an AND gate for logically ANDing the print data and an energization signal, and an OR gate for receiving an output from said AND gate and the selected pre-heat pulse signal.

14. The print head according to claim 11, wherein the selection information and print data are commonly input to a shift register for receiving and holding serial data.

15. The print head according to claim 11, wherein one of the plurality of pre-heat pulse signals is selected so that if the number of pulse signals is P, the number of types of selected and generated pre-heat pulses satisfies a condition ($P \leqq P' \leqq 2P$).

16. The print head according to claim 11, wherein said driving circuits pre-heat two adjacent print elements located near each of two end portions of the plurality of print elements on the board and two print elements near each of two end portions of the plurality of print elements on the neighboring board, by the same pre-heat pulse signal.

17. A print apparatus for printing an image on a recording medium by energizing and driving a print head of claim 11, comprising:

characteristic information storage means for storing print characteristics of the print elements of said print head;

transfer means for determining the selection information on the basis of the print characteristics stored in said characteristic storage information storage means, and transferring the determined selection information to said print head;

preliminary energization means for preliminary energizing two print elements near end portions of adjacent boards by outputting the plurality of pulse signals to said print head prior to a print operation; and print energization means for energizing the energization members of said print head so as to perform the print operation after the preliminary energization by said preliminary energization means.

18. The apparatus according to claim 17, wherein the driving circuits pre-heat two adjacent print elements located near each of two end portions of the plurality of print elements on the board and two print elements near each of two end portions of the plurality of print elements on the neighboring board, by the same pre-heat pulse signal.

19. The apparatus according to claim 17, wherein said print head comprises an ink-jet print head for performing a print operation by ejecting an ink.

20. The apparatus according to claim 19, wherein said print head comprises a print head for ejecting an ink by utilizing heat energy, and comprises a heat energy conversion member for generating the heat energy to be applied to the ink.

21. The apparatus according to claim 17, wherein said apparatus has a plurality of said print heads for respectively ejecting inks of different colors.

22. The apparatus according to claim 17, wherein the driving circuits preform a pre-heat operation by the same pre-heat pulse signal, in units of two adjacent print elements near each of two ends of the plurality of print elements on each of the boards, and in units of a plurality of blocks obtained by dividing the plurality of remaining print elements, and each of the plurality of blocks includes at least two print elements.

23. A print method for printing an image on a recording medium by energizing and driving a print head of claim 11, comprising the steps of:

determining selection information on the basis of a print characteristic of said print head;

transferring the selection information to said print head, and storing the selection information in the storage circuit;

outputting a plurality of pre-heat pulse signals to said print head prior to a print operation; and energizing the energization members of said print head in accordance with image data so as to perform a print operation after preliminary energization of said print head.

* * * * *

UNITED STATES PATENT AND TRADEMARK OFFICE

CERTIFICATE OF CORRECTION

PATENT NO. : 5,867,200

DATED : February 2, 1999

INVENTOR(S) : HIROKI TAJIMA ET AL.

It is certified that error appears in the above-identified patent and that said Letters Patent is hereby corrected as shown below:

Title page, item [57],

ABSTRACT

Line 4, "shiftregister" should read --shift register--.

IN THE DRAWINGS

Sheet 5, Figure 5, "EJCTION" should read --EJECTION--.

COLUMN 1

Line 11, "allows" should read --allow--.

COLUMN 2

Line 65, "results" should read --result--.

COLUMN 3

Line 6, "board," should read --boards,--.

COLUMN 4

Line 8, "energization.members," should read --energization members,--.

UNITED STATES PATENT AND TRADEMARK OFFICE

CERTIFICATE OF CORRECTION

PATENT NO. : 5,867,200

DATED : February 2, 1999

INVENTOR(S) : HIROKI TAJIMA ET AL.

It is certified that error appears in the above-identified patent and that said Letters Patent is hereby corrected as shown below:

COLUMN 8

Line 21, "pulse" should read --pulses--.

COLUMN 9

Line 6, "t3)" should read --(t3)--.

COLUMN 17

Line 29, "preform" should read --perform--.

COLUMN 18

Line 33, "preform" should read --perform--.

Signed and Sealed this

Fourth Day of January, 2000

*Attest:*

*Attesting Officer*

*Acting Commissioner of Patents and Trademarks*